US005088258A

United States Patent [19]

Schield et al.

[11] Patent Number: 5,088,258

[45] Date of Patent: Feb. 18, 1992

[54] THERMAL BROKEN GLASS SPACER

[75] Inventors: Edward L. Schield, Medford; Myron D. Reeves, Ladysmith, both of Wis.

[73] Assignee: Weather Shield Mfg., Inc., Medford, Wis.

[21] Appl. No.: 588,978

[22] Filed: Sep. 7, 1990

[51] Int. Cl.[5] ..... E04C 2/54; E06B 7/12

[52] U.S. Cl. ..... 52/398; 52/172; 52/402; 52/785; 52/788; 52/790

[58] Field of Search ..... 52/172, 397, 398, 403, 52/402, 171, 399, 400, 785, 788, 789, 790

[56] References Cited

U.S. PATENT DOCUMENTS

| | | | |
|---|---|---|---|
| 3,261,139 | 7/1966 | Bond | 52/398 X |
| 3,918,231 | 11/1975 | Kessler | 52/628 |
| 3,935,683 | 2/1976 | Derner et al. | 52/172 |
| 3,949,526 | 4/1976 | Sherlock et al. | 49/501 |
| 4,024,690 | 5/1977 | Collins et al. | 52/397 |
| 4,030,263 | 6/1977 | Lacombe | 52/616 |
| 4,057,945 | 11/1977 | Kessler | 52/398 |
| 4,113,905 | 9/1978 | Kessler | 428/34 |
| 4,193,236 | 3/1980 | Mazzoni et al. | 52/398 X |
| 4,222,213 | 9/1980 | Kessler | 52/790 |
| 4,268,553 | 5/1981 | Marzouki et al. | 428/34 |
| 4,322,926 | 4/1982 | Wolflingseder et al. | 52/172 |
| 4,411,115 | 10/1983 | Marzouki et al. | 52/309 |
| 4,464,874 | 8/1984 | Shea, Jr. et al. | 52/398 |
| 4,479,988 | 10/1984 | Dawson | 428/34 |
| 4,649,685 | 3/1987 | Wolf et al. | 52/398 |
| 4,669,241 | 6/1987 | Kelley | 52/400 |
| 4,691,486 | 9/1987 | Niekrasz et al. | 52/172 |
| 4,757,655 | 7/1988 | Jentoft et al. | 52/397 X |
| 4,831,799 | 5/1989 | Glover et al. | 52/172 |
| 4,853,264 | 8/1989 | Vincent et al. | 428/34 |
| 4,890,438 | 1/1990 | Tosa et al. | 52/172 |

FOREIGN PATENT DOCUMENTS

| | | | |
|---|---|---|---|
| 953159 | 8/1974 | Canada | 52/790 |
| 192363 | 8/1986 | European Pat. Off. | 52/172 |
| 8002403 | 11/1981 | Fed. Rep. of Germany | 52/788 |
| 2313538 | 2/1977 | France | 52/398 |
| 1028856 | 5/1966 | United Kingdom | 52/400 |
| 2148371 | 10/1983 | United Kingdom | 52/788 |

*Primary Examiner*—John E. Murtagh
*Assistant Examiner*—Deborah McGann Ripley
*Attorney, Agent, or Firm*—Price, Heneveld, Cooper, DeWitt & Litton

[57] ABSTRACT

An improved insulating spacer assembly for reducing heat transfer between panes of an insulated glazing unit comprises an extruded or roll-formed hollow metal spacer together with thermal breaks and primary sealant. The spacer and thermal breaks are preferably coextruded together, with the thermal breaks being extruded along the upper third portion of the spacer sidewalls, lengthwise along the spacer sidewall. The primary sealant is extruded along the middle third of the spacer sidewalls, parallel to and in cohering relationship to the thermal breaks. The invention also provides insulated glazing units wherein the spacer assembly is sandwiched between two glass panes to provide an exterior channel which is filled with a secondary sealant composition which also covers the exposed edges of the glass panes.

15 Claims, 1 Drawing Sheet

THERMAL BROKEN GLASS SPACER

BACKGROUND OF THE INVENTION

This invention relates to multiple pane sealed glazing units, particularly to multiple pane units having an insulating, spacing and sealing assembly.

Insulating glass units comprising at least two glass panels separated by a sealed dry air space are widely used in modern building construction for energy conservation to reduce building heat loss through glass surfaces. Sealed insulating glass units generally require spacer means for precisely separating the glass panels. Spacers currently used are generally tubular channels of aluminum or some other metal containing a desiccant to keep the sealed air space dry. The panes of glass are spaced from each other by the metal spacer and adhered to the spacer by a sealing composition applied between each pane and the spacing element. For example, a conventional method of assembling multiple glazing units is to apply a layer or bead of a sealing composition along opposite sides of the spacing element, and then engage the inner surfaces of the glass sheets along the marginal edge. The spacing element is placed between pre-cut glass sheets and the sheets are pressed together to adhere the sheets to the spacing element and to seal the internal air space between the glass sheets from the atmosphere.

The sealant composition is typically a thermoplastic adhesive composition which is applied as a hot melt. In placing the glass sheets to both sides of metal spacer, the sealant composition can be pressed out to such an extent that glass to spacer contact can result. The metal spacers are a much better or cold heat conductor than the surrounding air space and can provide an appreciable path for heat or cold flow. Direct metal-to-glass contact can result in by-passing the gap formed by the space between the panes with undesirable outside-to-inside heat or cold transfer effects. In practice, this effect can manifest itself as a visible line of condensation on the outside of the glass close to its edge, a point which serves to detract from the attractiveness of double glazing to the user. This can also result in a differential dimensional change between the spacer and the glass which can cause stress to develop on the glass and on the seal which can result in damage to and the failure of the solid glass unit.

There have been some attempts to use spacers made of plastic materials, rather than metal. This has, however, been unsuccessful because the sealants which provide relatively reliable bonds between the glass and metal spacers generally do not bond well to plastic spacers. The differential dimensional change that occurs between glass and plastic spacers over a certain range of temperature is much higher than with metal spacers. In addition, most plastics have been found unacceptable for use between glass panes because they can exude volatile materials, such as plasticizers, which could cloud or fog the interior glass surface. The cold flow of the mastic material can also result in penetration of moisture absorbed from the air by the thermoplastic adhesive to penetrate to the space between the pane.

SUMMARY OF THE INVENTION

In accordance with the present invention, there is provided an improved spacer assembly which is particularly adapted for use in forming multiple glass glazing units. More particularly, the present invention utilizes an improved metal spacer element which incorporates a thermal break which forms a poor conductive path between the glass panels, is effective to prevent direct metal spacer to glass contact, and reduces the tendency of sealing compositions to be squeezed from between the glass panes and the spacer, while functioning as a spacer to keep the glass panes a precise distance apart during construction of the sealed unit.

BRIEF DESCRIPTION OF THE DRAWINGS

The invention and other objects and advantages will be better understood in the followed detailed description of various embodiments cited for the sake of illustration with reference to the accompanying drawings in which.

DESCRIPTION OF THE PREFERRED EMBODIMENTS

Figure 1:
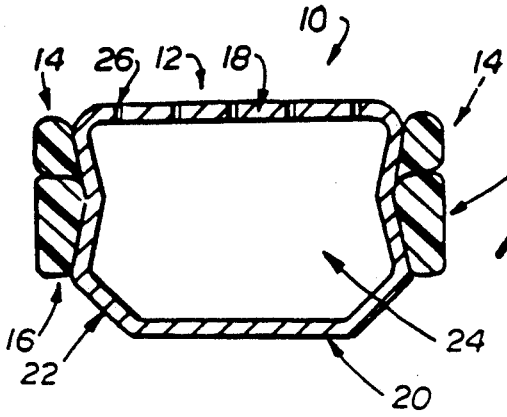
FIG. 1 a cross-sectional view of an embodiment of the invention spacer.

Referring to FIG. 1, there is shown a preferred embodiment of the invention spacer assembly, generally designated by reference numeral 10, comprising a generally rectangular hollow spacer 12, thermal break 14 and primary sealant 16. Spacer 12 is formed from a metal such as aluminum or steel, including various metal alloys, and is preferably anodized aluminum, either in the form of an extrusion or by rolling from flat strip material. Spacer 12 includes a top wall 18, a bottom wall 20 and sidewalls 22, which together define a hollow core 24 which is in communication with space 28 (FIG. 2) through holes, one of which is shown at 26, which are formed in top wall 18. The holes 26 are formed by conventional means following extrusion or during rolling of spacer 12. Hollow core 24 is generally filled with a desiccant material which is in communication with an inert gas such as nitrogen or, preferably, argon in space 28 between glass panes 30 to keep space 28 free of moisture which could otherwise condense and obscure the glass. As shown in the drawings, top wall 18 and bottom wall 20 are substantially parallel to each other and, although sidewalls 22 can also be formed substantially parallel to each other, they are preferably formed with inwardly sloping portions to form a concave section, with the bottom corners truncated as shown in the drawings.

Figure 2:
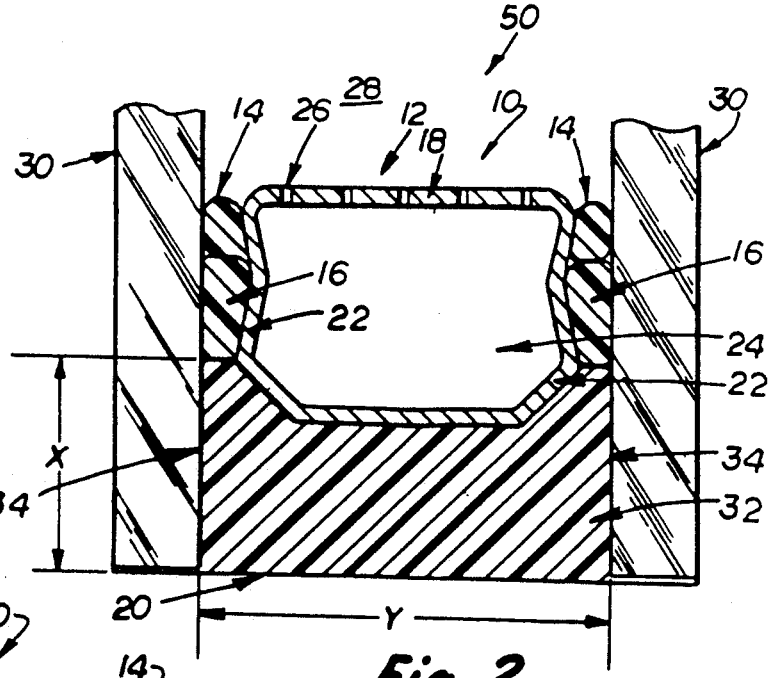
FIG. 2 an installation thereof.
Figure 3:
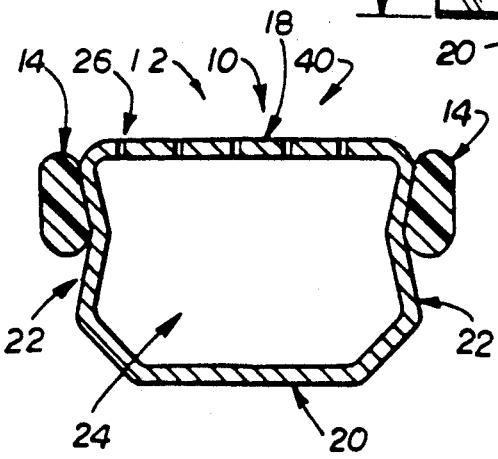
FIG. 3 shows a cross-sectional view of an intermediate embodiment of the invention.

The preferred shape of spacer 12 as shown in FIGS. 1-3 makes filling the annular space having the overall dimensions x and y between the exposed portions of sidewalls 22 and the bottom wall 20 of spacer and the exposed faces 34 of glass panes 30 more easy and efficient, improves flow of secondary sealant 32 into the exposed faces of glass panes 30, ensures more complete wetting by secondary sealant 32 of the exposed portions of spacer 12 and the exposed interior faces of panes 30 and more uniform coating of these exposed areas by secondary sealant 32; as well as significantly reducing, if not entirely eliminating, the possibility of void spaces being formed at or near the walls of panes 30 and/or spacer 12 which could lead to fracture stresses developing in secondary sealant 32 and result in undesirable heat transfer effects.

Thermal break 14 is formed from an extrudable thermoplastic resin composition which is dimensionally stable and flexible Preferred thermoplastic materials include those containing sufficiently small amounts of plasticizers and other volatile components that bleeding or exudation of volatiles from the extruded resin is minimal. Currently, polyvinyl chloride is the preferred resin for forming the thermal break 14 although other resins which exhibit dimensional stability, flexibility, low moisture absorption, good processibility and resistance to cold flow can be employed, such as polyphenylene oxide and polycarbonate. Thermal break 14 is extruded onto both sidewalls 22 of spacer 12 along at least a portion of the upper third of the sidewall, considering the orientation of the spacer as illustrated in the drawings. While thermal break 14 can be extruded onto an already formed spacer 12, it is currently preferred that spacer 12 and the dual beads or strips of thermal break 14 be simultaneously coextruded, whereby a more uniform and positive adhesion between thermal break 14 and metal spacer 12 is obtained.

Primary sealant 16 is also preferably formed from an extrudable thermoplastic sealant or mastic composition with butyl-based sealants particularly polyisobutylene sealent, being currently preferred. Primary sealant 16 can be described as a permanently elastic plastic. Suitable sealants are described in "Sealants for Insulating Glass Units," Strecker, *Adhesive Ace,* November, 1975, hereby incorporated by reference. Sealant 16 is extruded onto approximately at least a portion of the middle third of sidewalls 22, as illustrated in the drawings and extends lengthwise of sidewalls 22 in a parallel relationship to and in cohesive contact with thermal breaks 14. Primary sealant 16 has an extruded width that does not protrude significantly beyond the bead of thermal break 14, in order to ensure complete wetting of and contact with the interior face of glass panes 30 which sealant 16 faces. Although primary sealant 16 can be coextruded concurrently with spacer 12 and thermal breaks 14, it is currently a preferred practice to coextrude spacer 12 and thermal breaks 14 concurrently to form an intermediate spacer assembly 40 (FIG. 3) and subsequently extrude primary sealant 16 onto spacer 12. This second extrusion produces a firm connection between the thermal breaks 14 and the sidewalls 22 of spacer 12. In addition to forming a bond with sidewalls 22 and thermal breaks 14, primary sealant 16 also forms an adhesive bond with the glass panes 30 of the glazing unit 50 (see FIG. 2).

The construction of the sealed glazing unit is shown in FIG. 2 where the glass panes 30 are separated by the spacer assembly 10, and secured together by primary sealant 16 which bonds not only to the glass panes 30 but also to sidewalls 22 and thermal breaks 14. The desiccant material is placed within core 24 prior to assembling the unit. The ends of the straight lengths of spacer assembly 10 are mitered and joined to adjacent lengths at the corners by conventional means well known in the art. The completed spacer assembly 10 is dimensionally smaller than the glass panes 30 to leave a channel around the periphery of glass panes 30, which is over-filled with secondary sealant 32 to completely fill the peripheral channel and cover the exposed edges of glass panes 30, as illustrated in FIG. 2. Secondary sealant 32 is preferably a thermosetting plastic material, such as a silicone, polysulphide or epoxy polysulphide, with a two-part polyurethane sealant being currently preferred.

The result of the coextrusion and coherence of the thermal breaks 14 and the subsequent extrusion and coherence of primary sealants 16 onto and with the body of spacer 12 and thermal breaks 14 is a spacer assembly 10 which can be very economically produced in a manner to provide it with excellent mechanical qualities and an ability to effect a very good sealing of insulating glasswork, panels or the like which must be provided as multipaned or multi-wall structures. It will be understood, of course, that in application of the spacer assembly 10 for such purposes it will be provided in appropriate lengths, ends of which are complimentarily configured, to enable them to form a frame within and between outer edge portions of the facing surfaces of facing panes of insulating glass which seals the air space between the panes through the medium of primary sealant beads 16. At the same time, the thermal breaks 14 also serve to form a seal between sidewalls 22 and the glass panes 30. In addition, thermal breaks 14 also serve to provide a thermal break to prevent any significant heat transfer between glass panes 30 and the metal spacer 12, as well as preventing significant cold flow of primary sealants 16 during the formation of the units. Such an application of spacer assembly 10 is simply demonstrated in FIG. 2 of the drawing which illustrates a brief vertical section of a portion of a building utilizing thermal pane windows wherein the panes are separated by spacers in accordance with the present invention.

As heretofore pointed out and described, the spacer assembly of the invention is preferably produced by coextruding the thermal breaks 14 together with the metal spacer body 12. In a preferred embodiment of forming spacer assembly 10, an appropriate extrusion die is employed into which the parts are formed or fitted in which the materials are extruded separately but simultaneously to form parts. The spacer body 12 with thermal breaks 14 attached thereto is then shipped to a secondary manufacturing plant where the primary sealant strips or beads 16 are extruded onto the spacer body 12 in parallel, abutting relationship with thermal breaks 14. The spacer assembly 10 then is placed between the glass panes and the surface of the spacer body which is exposed is coated with the secondary sealant subsequent to extrusion, for example, by extruding the secondary sealant into the exposed spaces and over the exposed edges of each glass pane.

From the foregoing, it may be readily seen that the process of forming the product of the invention is extremely simple and provides the article of the invention in the form and with the characteristics of those herein described. Thus one not only solves the problem which the invention was intended to solve but also provides a product which is economical and simple to fabricate as well as most efficient and satisfactory in use. The obvious benefits which are provided by the invention which are highly important in this particular era in view of the necessity of saving energy in every way possible.

The following is emphasized in summary. The embodiment of the invention herein illustrated presents the preferred form in composition thereof and should not be construed as limiting. Furthermore, the preferred embodiment illustrated is substantially rectangular in cross section, and with reference to an application thereof, its side surfaces (as shown in FIG. 1) are those that face inwardly. The bottom surface is that which faces outwardly with reference to the structures to and between which it may be applied. At the same time, the longitudinally extending primary sealant strips or beads 14 are cohered to sidewalls 22 and are compressed during assembly of the glass pane 30 to the sidewalls 22 to adhesively cohere the panes 30 to spacer 12. The compression also insures complete merging of the thermal breaks 14 and primary sealants 16 along their length and forms a well defined seal to further limit undesirable heat transfer effects and/or moisture condensation. As previously set forth, the thermal breaks 14 on each of the sidewalls 22 are arranged to form parallel longitudinally extending, beads or strips which are parallel and cohered to the primary sealant strips or beads 16. Accordingly, as the glass panes 30 are applied in abutting relationship to the spacer assembly 10, thermal breaks 14 interact to precisely locate spacer assembly 10 between panes 30 and to substantially eliminate contact between panes 30 and metal spacer 12 by substantially eliminating cold flow of primary sealant 16 during assembly of insulating glazing units. Thermal breaks 14 also interact with primary sealant beads 16 during installation to permit sealant beads 16 to completely cover and adhere to the interior faces of glass panes 30. The flexibility of thermal breaks 14 permits expansion and contraction of thermal breaks 14 during exposure of glazing units 50 to environmental conditions while substantially negating shifts in the original position of spacer assembly 10 as installed. The dimensional stability of thermal beads 14 also uniformly responds to compressional stresses during installation of spacer assembly 10 between panes 30 around the entire periphery of glazing unit 50 to eliminate breakage from an unequal stresses and this uniform response continues while glazing unit 50 is exposed to its environment.

Having described the invention, it will be apparent that modifications and variations are possible without departing from the scope of the invention defined in the appended claims.

The embodiments of the invention in which an exclusive property or privileged is claimed or defined as follows.

1. An insulating spacer assembly for separating at least one pair of glass panes of an insulating glazing unit comprising:

a hollow metal spacer for interposition between two glass panes;

a thermal break element comprising a normally solid, dimensionally stable, flexible, thermoplastic resin extending longitudinally of said spacer and sealingly secured to at least a portion of the two sides of said spacer which face the glass panes;

a primary sealant composition comprising a permanently elastic plastic sealing composition capable of cold flowing and adhesively secured to each of the two sides of the spacer which face the glass panes, said primary sealant being parallel to said thermal break and running lengthwise along the spacer wall, said primary sealant covering at least a portion of the two sides of the spacer which face the glass panes, said primary sealant being in sealing contact with a lower portion of said thermal break; and said thermal break element having sufficient dimensional stability to minimize cold flow of said primary sealant to reduce the tendency of said primary sealant to be squeezed from between said glass panes and said spacer during assembly or use of an insulating glazing unit.

2. An insulating spacer assembly in accordance with claim 1 wherein the hollow portion of said meal spacer is filled with a desiccant material and the top face of the spacer between the parallel thermal breaks is provided with a series of holes permitting communication between the desiccant material and the air space outside said spacer.

3. The insulating spacer assembly of claim 1 in which the metal spacer and thermal break are simultaneously extruded.

4. An insulating spacer in accordance with claim 1 wherein said thermal break comprises polyvinyl chloride.

5. An insulating spacer in accordance with claim 4 wherein said primary sealant composition comprises a butyl-based adhesive.

6. An insulated glazing unit comprising:

a plurality of spaced glass panes;

a spacer adhesive separating adjacent pairs of said spaced glass panes at periphery portions thereof, said spacer assembly comprising:

a hollow metal spacer including a top wall, a bottom wall and two sidewalls, thermal break elements each comprising a dimensionally-stable, flexible thermoplastic resin firmly attached to the sidewalls of said spacer and extending lengthwise of said spacer; a first permanently elastic plastic sealant capable of cold flowing and firmly attached to said spacer and cohered to a portion of said thermal break element, said first sealant extending lengthwise of and adhered to said spacer along the spacer sidewalls parallel to and in cohesive contact with said thermal break element; said thermal break elements each being in abutting relationship with one of said glass panes; said plastic sealant adhesively bonding said spacer to said glass panes;

said thermal break element having dimensional stability to minimize cold flow of said primary sealant to reduce the tendency of said primary sealant to be squeezed from between said glass panes and said spacer during assembly or use of an insulating glazing unit; and a second sealant composition covering the exposed portions of said spacer, the exposed portions of said first sealant, and the exposed inner faces of said glass panes adjacent the entire periphery of said adjacent pairs of spaced glass panes.

7. An insulated glazing unit according to claim 6 wherein said thermoset secondary sealant comprises polyurethane.

8. An insulated glazing unit according to claim 6 wherein said spacer comprises parallel top and bottom walls, the top wall facing the air space between the glass panes and a pair of sidewalls, at least a portion of each sidewall being a concave section and wherein a portion of the bottom wall and the adjacent sidewall form a truncated section.

9. An insulated glazing unit according to claim 6 wherein said thermal break comprises polyvinyl chloride.

10. An insulated glazing unit according to claim 9 wherein said primary sealant composition comprises a butyl-based adhesive.

11. An insulated glazing unit according to claim 6 wherein said thermal break comprises polyvinyl chloride.

12. An insulated glazing unit according to claim 11 wherein said primary sealant comprises a butyl-based adhesive.

13. An insulated glazing unit in accordance with claim 6 wherein said hollow metal spacer 3 is filled with a desiccant material and the top face of said surface between said thermal breaks is perforated to permit communication between the desiccant material and the air space between said glass panes.

14. An insulated glazing unit according to claim 13 wherein said air space is filled with an inert gas.

15. An insulated glazing unit according to claim 14 wherein said inert gas is argon.

* * * * *

UNITED STATES PATENT AND TRADEMARK OFFICE

CERTIFICATE OF CORRECTION

PATENT NO. : 5,088,258

DATED : February 18, 1992

INVENTOR(S) : Edward L. Schield et al.

It is certified that error appears in the above-identified patent and that said Letters Patent is hereby corrected as shown below:

Column 2, line 18:
After "Fig. 2" insert --shows--.

Column 3, line 26:
"Adhesive Ace" should be --Adhesive Age--.

Column 4, line 68:
"beads 14" should be --beads 16--.

Column 5, claim 2, line 67:
"meal" should be --metal--.

Signed and Sealed this

Seventeenth Day of August, 1993

Bruce Lehman

*Attest:*

BRUCE LEHMAN

*Attesting Officer*

*Commissioner of Patents and Trademarks*